United States Patent [19]

Nelson

[11] Patent Number: 4,903,504

[45] Date of Patent: Feb. 27, 1990

[54] EVAPORATOR DEVICE FOR ICE-MAKING APPARATUS

[75] Inventor: Kenneth L. Nelson, Albert Lea, Minn.

[73] Assignee: King-Seeley Thermos Co., Prospect Heights, Ill.

[21] Appl. No.: 298,957

[22] Filed: Jan. 19, 1989

[51] Int. Cl.[4] ..... F25C 1/04

[52] U.S. Cl. ..... 62/347; 165/133

[58] Field of Search ..... 62/347, 348, 352; 165/133

[56] References Cited

U.S. PATENT DOCUMENTS 2,579,898 12/1951 Brucker ..... 165/133 X 3,280,588 10/1966 Brindley ..... 62/347 X 3,430,452 3/1969 Dedricks et al. ..... 62/138

4,510,114 4/1985 Nelson ..... 264/261

*Primary Examiner*—William E. Tapolcai

*Attorney, Agent, or Firm*—Harness, Dickey & Pierce

[57] ABSTRACT

A new and improved combination evaporator and ice-forming device preferably includes an interlocking grid-type ice-forming plate arrangement with water-receiving and ice-forming recesses being defined by the interlocking grid members. The preferred embodiments include a pair of such plate subassemblies interconnected in a back-to-back relationship with an evaporator tube disposed therebetween. Novel water distribution and frame and housing arrangements are also disclosed.

10 Claims, 5 Drawing Sheets

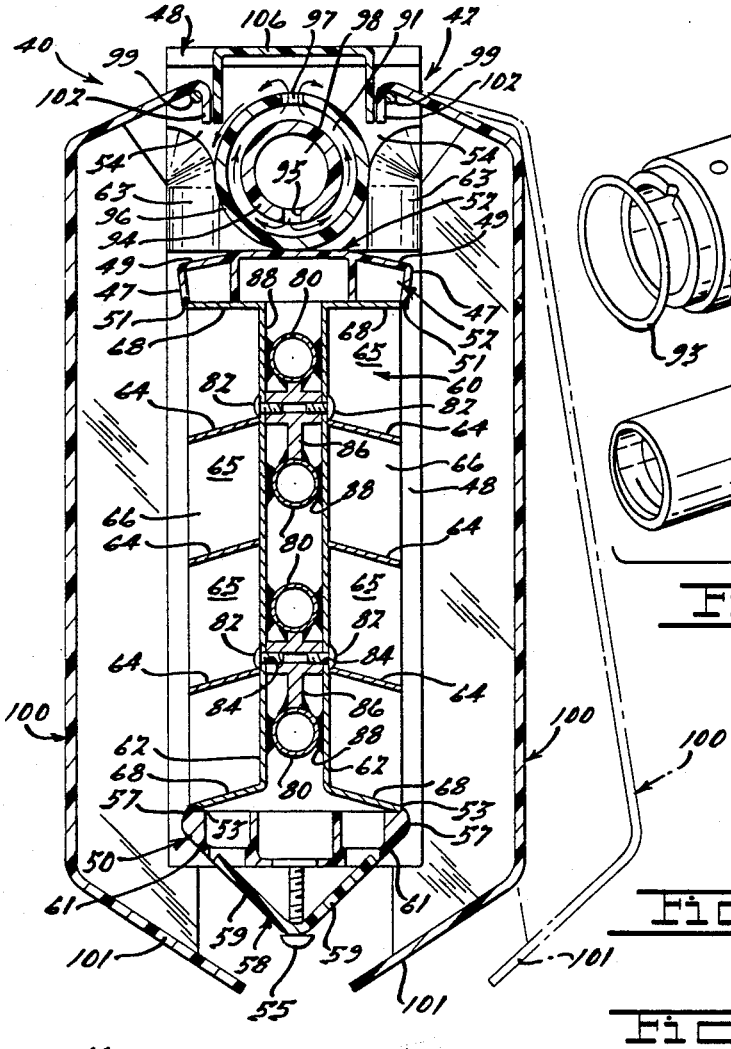
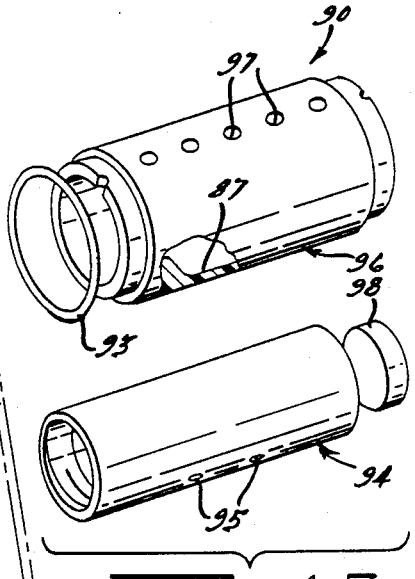
FIG. 13.
FIG. 8.
FIG. 9.
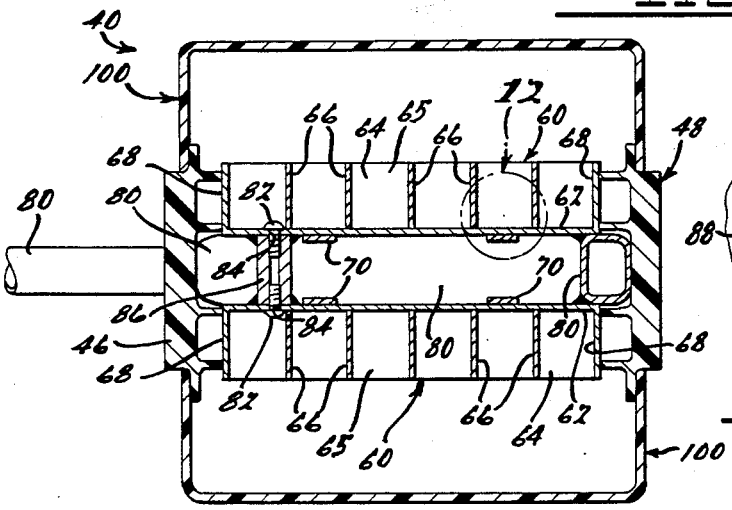
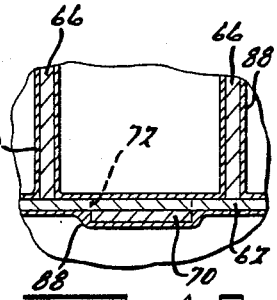
FIG. 12.

FIG. 10.
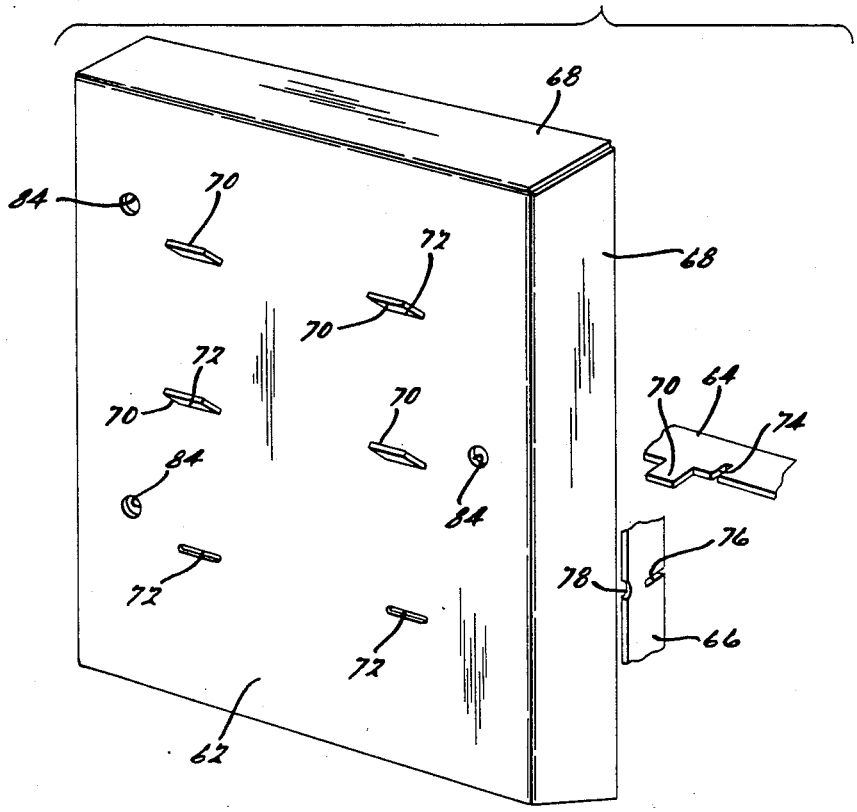
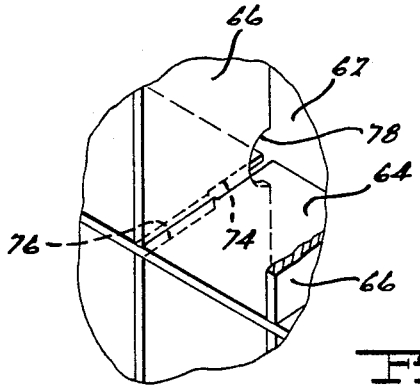
FIG. 11.

EVAPORATOR DEVICE FOR ICE-MAKING APPARATUS

BACKGROUND AND SUMMARY OF THE INVENTION

Generally speaking, the present invention is directed toward an ice-making machine for producing cube-type ice products of the type commonly used for cooling beverages and the like. More specifically, the invention is directed toward a cube-type ice-making machine that preferably includes a vertically-arranged combination evaporator and ice-forming device for forming ice products in pockets or recesses on opposite sides of the device.

A novel water distribution arrangement is provided adjacent the top of an array of water-receiving and ice-forming pockets for evenly distributing ice make-up water in a cascading flow into and over the pockets or recesses. In addition, a novel evaporator and ice-forming plate assembly is composed of a plurality of horizontal and vertical grid members interconnected with one another in an interlocking relationship, with the interlocked grid members being secured to an inner plate member. These subassemblies are preferably interconnected, back-to-back with an evaporator tube secured therebetween.

The novel evaporator and ice-forming device also includes a new and improved driplet arrangement for receiving water that has cascaded over the entire vertical arrangement of ice-forming pockets or recesses and directing such water to a sump arrangement having a drain or a recirculation system.

Although other plate-type and grid-type arrangements in combination evaporator and ice-forming apparatuses have been provided in the past and have performed rather well, the unique construction of the combination evaporator and ice-forming device of the present invention provides for enhanced ease, convenience, and economy in manufacture and assembly, as well as greatly increased energy efficiency and ice cube production. In addition, the combination evaporator and ice-forming device of the present invention provides for a compact, space-saving arrangement that effectively allows for greater and faster ice production in applications where the space occupied by the ice-making machine is at a premium.

Additional objects, advantages, and features of the present invention will become apparent from the following description and the appended claims, taken in conjunction with the accompanying drawings.

BRIEF DESCRIPTION OF THE DRAWINGS

FIG. 8 is a cross-sectional view of the combination evaporator and ice-forming device of FIG. 3, taken generally along line 8—8 of FIG. 3.

FIG. 9 is a cross-sectional view of the combination evaporator and ice-forming device of FIG. 3, taken generally along line 9—9 of FIG. 3.

FIG. 10 is a rear elevational perspective view of an ice-forming plate subassembly of the combination evaporator and ice-forming device of FIG. 3, shown at an intermediate stage of its construction, with portions of horizontal and vertical grid members removed and shown in a fragmentary representation.

FIG. 11 is a detailed view of the ice-forming plate subassembly for the combination evaporator and ice-forming device of FIG. 3, viewed from the front side thereof, and illustrating some of the details of its construction.

FIG. 12 is a detailed view of the circled portion of FIG. 9, indicated generally by the arrow 12 in FIG. 9.

FIG. 13 is an exploded view of the water distribution subassembly of the combination evaporator and ice-forming device of FIG. 1.

DETAILED DESCRIPTION OF THE PREFERRED EMBODIMENTS

Figure 1:
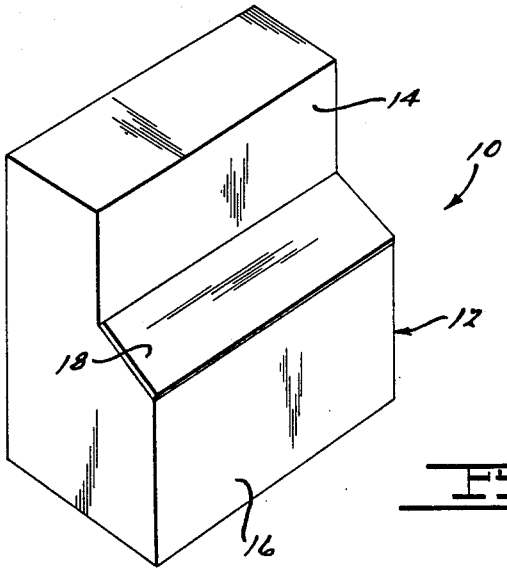
FIG. 1 is an elevated perspective view of an ice-making machine incorporating the principles of the present invention.

FIGS. 1 through 14 illustrate various preferred embodiments of various aspects or subassemblies of a combination evaporator and ice-forming device according to the present invention. It should be noted that the various features of the invention shown in the drawing figures can be employed alone, in various combinations, or preferably all in conjunction with one another in order to provide a new and improved evaporator and ice-forming device for an ice-making machine. It should further be noted, however, that the various principles of the present invention described herein and illustrated in the accompanying drawings are equally applicable to ice-making machine configurations, or evaporator and ice-forming device configurations, other than the exemplary configurations shown for purposes of illustration in the drawings.

Figure 2:
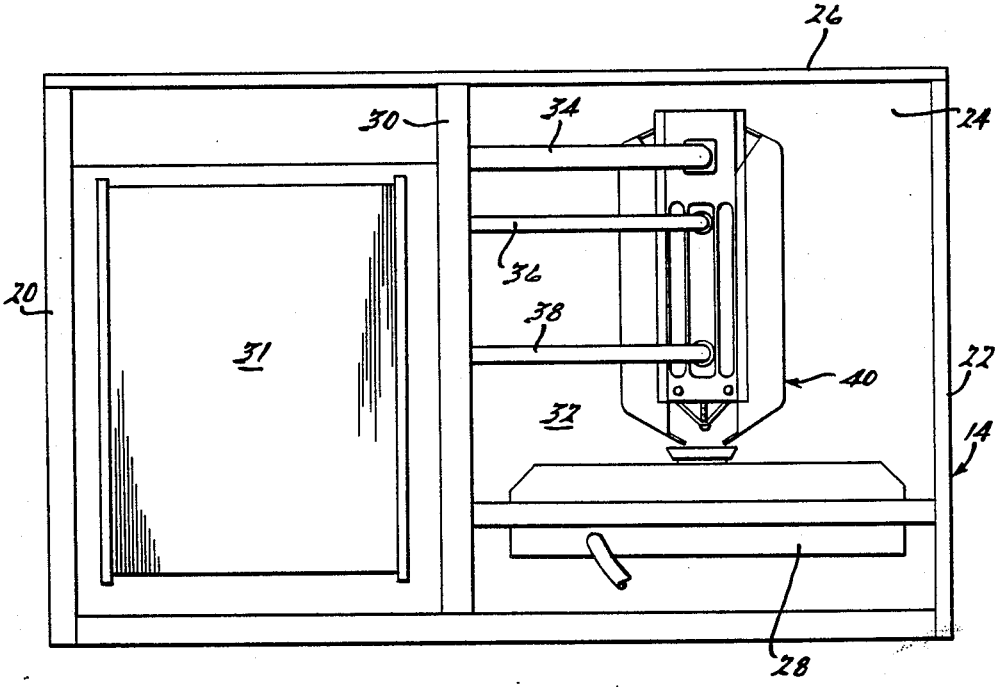
FIG. 2 is a front elevational view of a portion of the ice-making portion of the ice-making machine shown in FIG. 1.

In FIG. 1, an ice-making machine 10, in accordance with one preferred embodiment of the present invention, generally includes an enclosure or cabinet 12 having an upper ice-making section 14, a lower ice-receiving and storage section 16, and a suitable access door 18. As illustrated in FIG. 2, the upper ice-making machine 14 of the enclosure 12 generally includes a pair of laterally spaced, generally vertically disposed end walls 20 and 22, with front and rear walls extending laterally between the end walls 20 and 22, and a cover or top 26. In FIG. 2, such rear wall is identified by reference numeral 24; but the front wall is removed in order to reveal various interior components.

Within the ice-making section 14, a supporting partition or wall 30 is arranged generally parallel to the end walls 20 and 22, and extends between the front wall (not shown) and the rear wall 24 in order to divide the interior of the upper ice-making section 14 into a refrigeration area 31 and an ice-making area 32. As is conventional in the art, the refrigerating area 31 is provided with a suitable refrigeration compressor and condenser, which cooperate with an evaporator and ice-forming device 40 in the ice-making area 32.

Since the compressor and condenser components are conventional and well-known in the art, they are not illustrated in FIG. 2, but are connected through conventional refrigeration lines and function in the usual manner such that gaseous refrigerant at relatively high pressure is supplied by the compressor to the condenser, with the refrigerant being cooled and liquified as it passes through the condenser. The cooled and liquified refrigerant flows from the condenser to the evaporator and ice-forming device 40 by way of conventional refrigerant supply and return lines 36 and 38, respectively, where the refrigerant is vaporized by the transfer of heat thereto from water being frozen in the evaporator and ice-forming device 40. The gaseous refrigerant then flows from the evaporator and ice-forming devices 40 back to the inlet or suction side of the compressor for receycling through the refrigeration cycle.

Ice make-up water is supplied to the evaporator and ice-forming devices 40 by way of a conventional water supply line 34. Water falling from the evaporator and ice-forming devices 40 is collected in a sump system 28, which functions to direct such water to a drain or to a recirculation system, both of which are well-known and conventional in the art.

One skilled in the art will readily appreciate that the present invention is not limited to the specific construction of the enclosure 12 of the ice-making machine 10, and the inventive features described below can be adopted in various types of enclosures or incorporated into various existing types of refrigeration systems that do not necessarily require the various structural components and arrangements illustrated in the drawings. In addition, the structural relationship of the ice-making section 14 being disposed above the ice-storage section 16, as shown in FIG. 1, is no way intended to be limiting to the principles of the present invention since the ice storage area associated with the ice-making apparatus of the present invention may be located in other physical relationships, including remote locations, with respect to the evaporator and ice-forming devices 40, without departing from the spirit and scope of the present invention. Also, because of the advantageous size and configuration of the ice-forming assemblies described below, remote ice-making at various locations may be feasible from central refrigeration compressors and condensers.

FIGS. 3 through 9 generally illustrate a preferred evaporator and ice-forming device 40 according to the present invention, with various specific details being shown in FIGS. 10 through 13. In the exemplary evaporator and ice-forming device or assembly 40 shown in the drawings, a single or common frame assembly 42 generally surrounds, houses, and supports at least one, but preferably a pair of, ice-forming plate subassemblies 60, a common driplet member 58, and a common water distribution subassembly 90, with ice shields 100 pivotally-attached to the frame assembly 42 for each ice-forming plate subassembly 60. The common frame assembly 42 preferably includes a first side member 46, a second side member 48, a lower member 50, and an upper member 52, with a pair of retainer members 54 serving to retain and support the water distribution subassembly 90.

Suitable openings 56 are provided in the side member 46 for accommodating inlet and outlet portions of a generally serpentine evaporator tube 80, which is described in more detail below. Furthermore, a similar opening is provided in the side member 46, through which a water inlet connector 92 extends in order to communicate ice make-up water from the water supply line 34 to the water distribution subassembly 90, which also is described in more detail below. Preferably the internal orifice or opening through the water inlet connector 92 is sized to serve as a flow control to regulate the amount of water fed to the water distribution subassembly 90. In this regard, it should be noted that although no such openings are illustrated in the opposite side member 48, the side members 46 and 48 can optionally be of an identical construction and configuration, having the above-mentioned evaporator tube and water inlet openings, in order to eliminate inconvenience in assembly of the evaporator and ice-forming device 40, as well as allowing for interchangeability of the side members 46 and 48. The various components of the frame assembly 42, which are preferably injection-molded or otherwise formed from a plastic or other relatively heat insulating material, are interconnected with one another by way of a number of suitable fasteners 44 extending through the side members 46 and 48, and into the lower and upper members 50 and 52, respectively.

Portions of the frame side members 46 and 48 extend upwardly above the upper member 52 in order to retain or trap the retainer members 54 and the water distribution subassembly 90 therebetween. Furthermore, the lower and upper members 50 and 52, respectively, preferably include ridges, edges, or other such overlapping discontinuities for retaining and confining the ice-forming plate subassembly 60 within the common frame assembly 42, as indicated at reference numerals 51 and 53, respectively, in FIG. 8. Similarly, the driplet member 58 (described in more detail below) is interconnected with the frame assembly 42 preferably by way of suitable fasteners 55 extending through the driplet member 58 into the lower frame member 50. By such a construction, the frame assembly 42 provides for a single, common frame or housing structure for supporting and retaining the back-to-back, ice-forming plate subassembly described below, with a common water distribution subassembly 90 and a common driplet member 58 serving both sides thereof. Further in this regard, pivot pins 99 are preferably provided on each of the retainer members 54, for pivotally attaching the preferably plastic ice shields 100 to the frame assembly 42.

Figure 3:
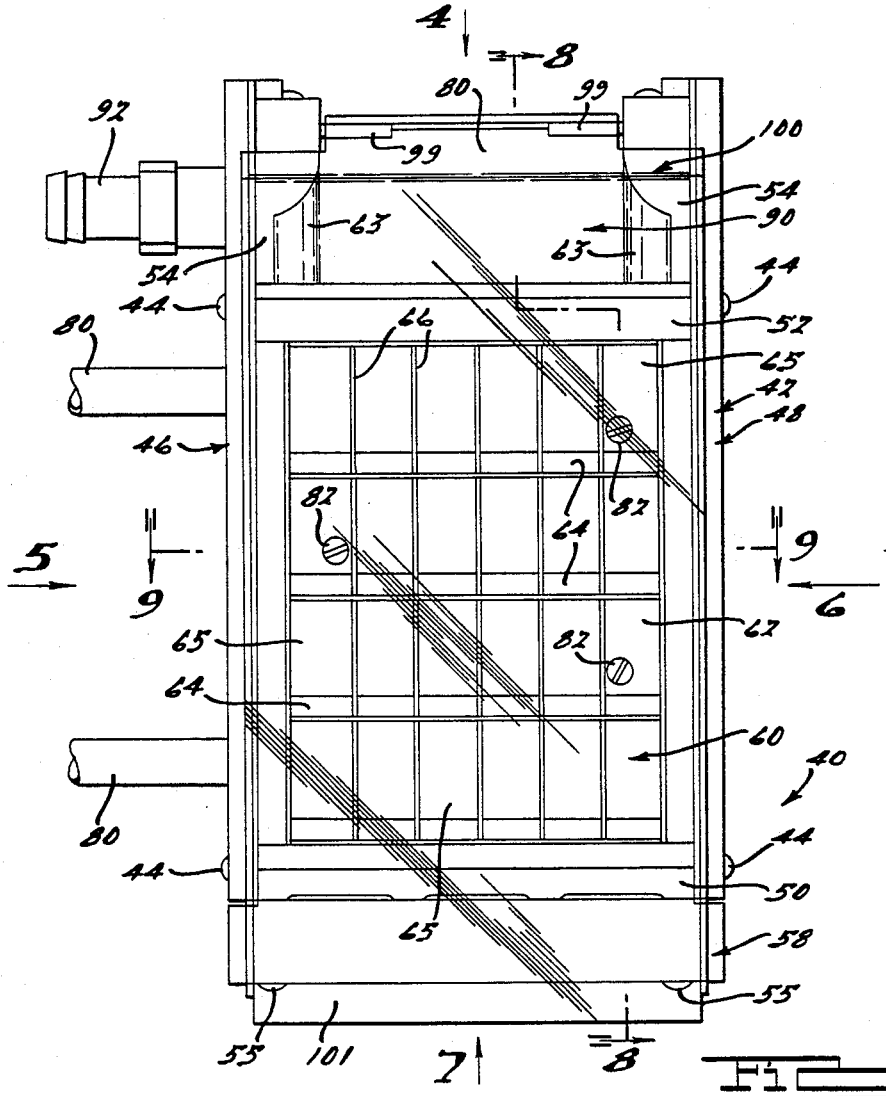
FIG. 3 is an elevational view of a combination evaporator and ice-forming device or assembly according to the present invention.

Each of the ice-forming plate subassemblies 60 preferably includes an inner plate 62, with a number of horizontal grid members 64 and a number of vertical grid members 66 interlockingly interconnected with one another and secured to the inner plate member 62, and with peripheral walls 68 of the inner plate member 62 generally surrounding the horizontal and vertical grid members 64 and 66, respectively. The intersecting and interlocking horizontal and vertical grid members 64 and 66 combine to form an array of water-receiving pockets or recesses 65, arranged in vertical and horizontal rows, as perhaps best viewed through the ice shields 100, which are shown in FIG. 3 as being composed of a clear plastic material merely for illustration in order to allow the inner components to be more easily viewed in the assembly drawing figures. Such ice shields 100 can be a clear plastic in practice, but are more preferably molded or otherwise formed of a plastic material and color that would aesthetically blend with, or complement, the surrounding ice storage compartment.

Preferably, the serially-spaced horizontal grid members 64 are disposed at a downwardly-sloping angle of approximately fifteen to sixteen degrees with respect to the vertical inner plate member 62. Such an angular relationship has been found to provide an optimum compromise between the open configuration of the water-receiving recesses 65 needed to assure proper ice removal during ice product harvest, but still providing for adequate flow of ice make-up water along the faces of the ice-forming plate subassembly 60, into and out of the water-receiving recesses 65 along both the upper and lower surfaces of the horizontal grid members 64.

As perhaps best illustrated in FIGS. 8 through 12, the horizontal and vertical grid members 64 and 66, respectively, are interlockingly attached to one another in a so-called "egg crate" configuration. The horizontal grid member 64 have interlocking slots 74 formed along their inner edges and extending partially outwardly therefrom, and the vertical grid member 66 have complementary interlocking slots 76 formed along their outer edges and extending partially inwardly therethrough. As shown in FIG. 11, such interlocking slots 74 and 76 in the horizontal and vertical grid members 64 and 66, respectively, are formed at the intersections of the horizontal and vertical grid members 64 and 66, respectively, thus allowing the grid members to be interlockingly interconnected to form a grid subassembly.

In the preferred, exemplary embodiments depicted in the drawings, the horizontal grid members 64 also include a number of inwardly-directed tabs 70 protruding therefrom and adapted to be received within complementary elongated openings 72 formed in the inner plate 62. Thus, when the horizontal and vertical grid members 64 and 66, respectively, are assembled together in their interlocking "egg crate" configuration, the interlocked grid subassembly can be easily and conveniently assembled to the inner plate member 62 and interlockingly secured thereto by bending the tabs 70 over against the inner surface of the inner plate member 62, as illustrated in FIGS. 10 through 12.

A number of openings 84 are provided in each inner plate member 62, for receiving suitable fasteners 82, which engage a corresponding number of bosses or spacers 86, which are disposed between the back-to-back inner plate member 62 of the ice-forming plate subassemblies 60 in order to secure the subassemblies 60 to one another, with the generally serpentine evaporator tube 80 disposed between the back-to-back inner plate members 62. The bosses or spacers 86 also serve to maintain the proper spacing between adjacent portions of the generally serpentine evaporator tube 80. Once the ice-forming plate subassemblies 60 are secured together as described above with the evaporator tube 80 therebetween, this entire subassembly is preferably coated (such as by dipping) as a unitized structure with a suitable heat conductive coating 88, which is perhaps best illustrated in FIGS. 8 and 12. By such a construction, this subassembly is self-supporting in its assembled condition, with the horizontal and vertical grid members 64 and 66 maintained in a proper and desired right-angle relationship with respect to one another by virtue of the interlocking relationship of the tabs 70 extending through the elongated opening 72 in the inner plate member 62. This construction aids in attaching and bonding the various components of the unitized ice-forming plate subassemblies 60 to one another, and results in a higher density of interconnection, enhanced structural integrity, and improved heat transfer bonding therebetween. Furthermore, because of the identical, but oppositely-directed, configuration of the ice-forming plate subassemblies 60 on opposite sides of the evaporator tube 80, an improved symmetry or concentricity of heat transfer is attained. This in turn results in greater efficiency and uniformity of the freezing or ice-forming heat transfer operation, and eliminates the energy waste and inefficiency resulting from configurations wherein an evaporator tube is disposed adjacent to only one ice-forming plate subassembly, with its heat removal capabilities on the opposite side of the evaporator tube being wasted.

Furthermore, in order to facilitate the proper flow of ice make-up water from one water-receiving recess 65 to a vertically adjacent water-receiving recess 65, as well as for purposes of providing air circulation to prevent a vacuum effect during the defrost or harvest cycle wherein ice is removed from the subassembly, the vertical grid members 66 preferably include water communication openings 78 formed generally at their intersections with the horizontal grid members 64. Such water communication openings 78 cooperate with the correspondingly located interlocking slots 74 in the horizontal grid member 64 in order to provide the improved water communication and vacuum-preventing air circulation effects mentioned above.

It should be noted that although the elongated openings 72 are illustrated in the drawings as being oriented horizontally in the inner plate member 62, with the tabs 70 being disposed on the horizontal grid member 64, and correspondingly with the water communication openings 78 being formed in the vertical grid members 66 for cooperation with the interlocking slots 74 in the horizontal grid member 64, these relationships can optionally be reversed. In such a reversed arrangement, the tab members 70 would be formed on the vertical grid members 66 to extend through correspondingly vertically elongated openings 72 in the inner plate members 62, and the water communication openings 78 can also optinally be formed in the horizontal grid members 64 for cooperation with correspondingly located interlocking slots in the vertical grid members 66. Either of these relationships can interchangeably be reversed, but the arrangement illustrated in the drawings has been found to be the preferred arrangement.

The major components of the water distribution subassembly 90 are illustrated in an exploded perspective view in FIG. 13, and in a cross-sectional view in FIG. 8. The water distribution subassembly 90 generally includes an inner water tube 94, which is connectable to the above-mentioned water inlet connector 92 shown in FIGS. 3 and 5, an outer water tube 96, an O-ring 93, and a sealing plug member 98. The inner water tube 94 is disposed concentrically within the outer water tube 96, with opposite ends of the outer water tube 96 fitting rather tightly around the inner water tube 94, but with a radially-outwardly recessed intermediate portion 87 of the outer water tube 96 defining an annular space 91 extending circumferentially around the inner water tube 94.

The inner water tube 94 has a number of generally vertically extending, downwardly-directed openings 95 along its lower edge, and the outer water tube 96 has a number of generally vertically-extending, upwardly-directed openings along its upper edge. Thus, when the inner and outer water tubes 94 and 96, respectively, are assembled within, and retained by, the retainer members 54, ice make-up water can be communicated through the water inlet connector 92 into the interior of the inner water tube 94, and then flow downwardly through the inner tube opening 95 to the annular space 91. The ice make-up water then flows upwardly, under pressure, through the flooded annular space 91 on both radial sides of the inner water tube 94 to flow upwardly and outwardly through the outer tube openings 97 along the top of the outer water tube 96. Once the water has been discharged from the openings 97, it flows along the outer peripheral sides of the outer water tube 96 and downwardly along the sloped upper surfaces 49 and the inwardly-sloped surfaces 47 of the upper frame member 52. The ice make-up water then flows along the inner surfaces of the water-receiving pockets or recesses 65 of the ice-forming plate subassemblies 60, and ice products are formed in the water-receiving recesses 65 due to the refrigeration effect of refrigerant flowing through the evaporator tube 80. Such flow of the ice make-up water in the distribution subassembly 90 is generally indicated by a series of flow arrows in the upper portion of FIG. 8.

Figure 4:
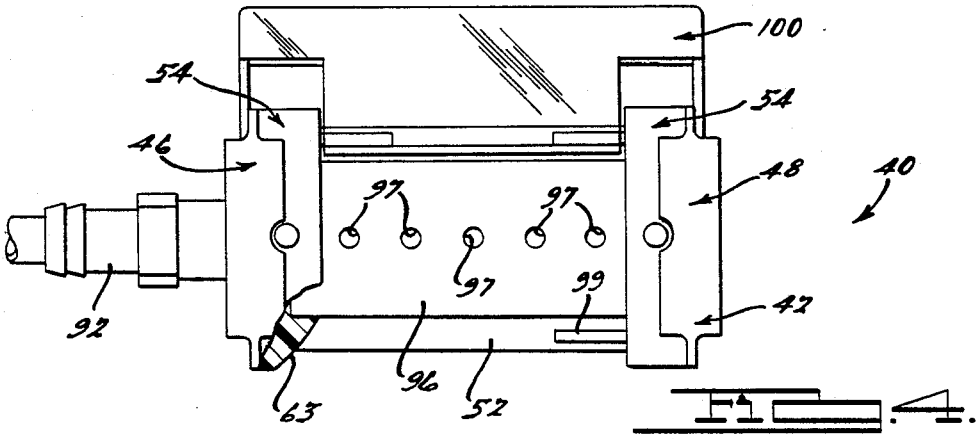
FIG. 4 is a top view of the combination evaporator and ice-forming device of FIG. 3, looking generally in the direction of the arrow 4.
Figure 5:
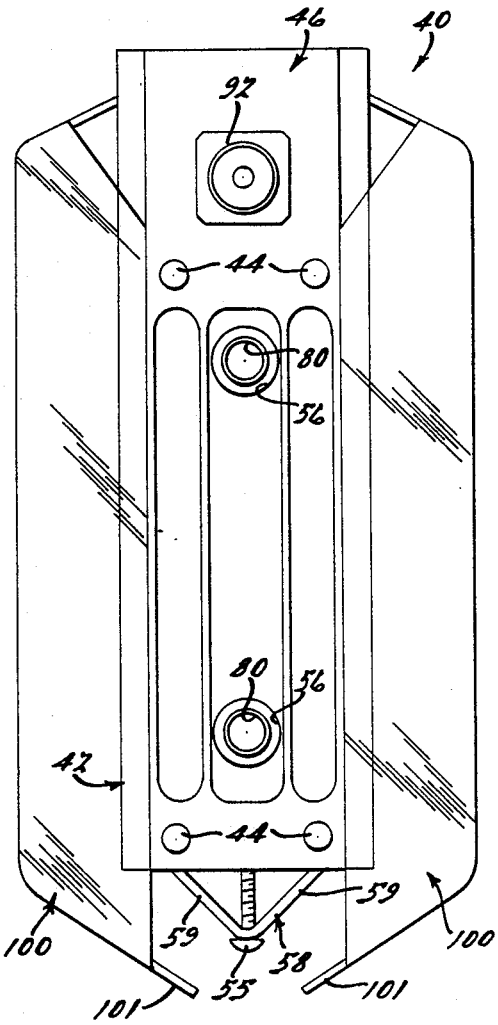
FIG. 5 is a side view of the combination evaporator and ice-forming device of FIG. 3, looking generally in the direction of the arrow 5.
Figure 6:
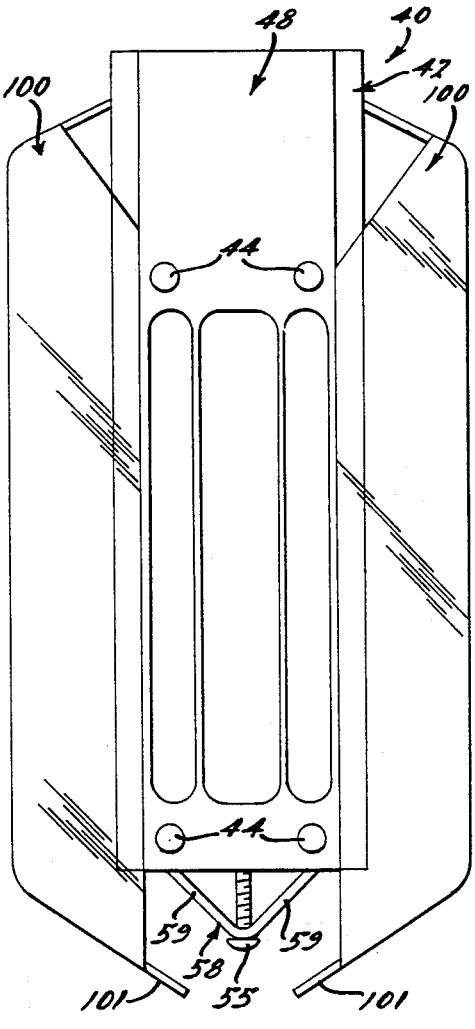
FIG. 6 is an opposite side view of the combination evaporator and ice-forming device of FIG. 3, looking generally in the direction of the arrow 6.
Figure 7:
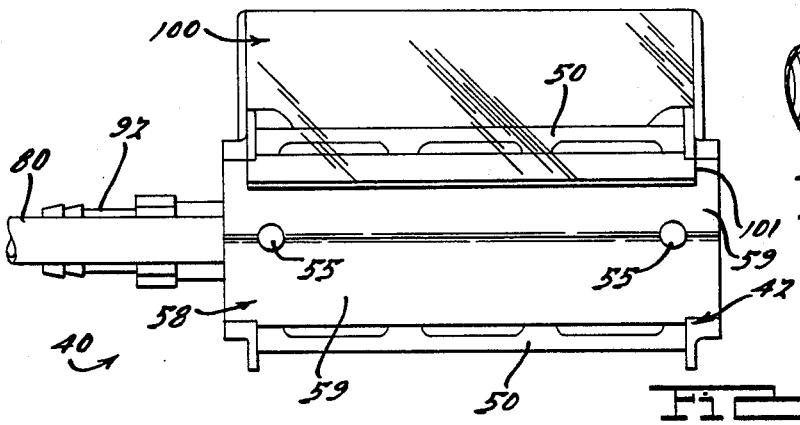
FIG. 7 is a bottom view of the combination evaporator and ice-forming device of FIG. 3, looking generally in the direction of the arrow 7.

The retainer members 54 each preferably include curved frontal portions 63 on each side, as shown, for example, in FIGS. 3, 4 and 8. This curved shape of the portions 63 functions to attract or direct make-up water flow from the subassembly 90 toward the laterally outer edges (or flanged sides) of the side members 46 and 48. Without such curved shape, the flowing (or cascading) make-up water would tend to stay more toward the medial areas of the ice forming plates 60, due primarily to the surface tension of the make-up water, and would thus not completely fill the water-receiving recesses along the outer edges.

By way of the water distribution arrangement described above, the present invention provides for more even and controlled flow of ice make-up water generally equally to both sides of the symmetrically-arranged ice-forming plate subassemblies 60. Such equal distribution and more regulated bubbling flow results largely from the fact that the annular space 91 is sized such that it is substantially filled or flooded during ice make-up water flow. Such even distribution also results largely from the fact that the inner tube openings 95 are directed downwardly, diametrically opposite from the upwardly-directed outer tube openings 97. Furthermore, this arrangement eliminates the need for two rows of holes, one to supply ice make-up water to each of the ice-forming plate subassemblies 60, or the need for two separate water supply manifolds. In addition, this arrangement has been found to allow for the use of larger inner and outer tube openings 95 and 97, respectively, which therefore do not plug with scale or particles as easily or quickly as in other distribution systems having smaller holes.

Undesirable leakage is substantially prevented by the O-ring 93 at the inlet end of the inner water tube 94, which prevents leakage at such inlet end between the inner and outer water tubes 94 and 96, respectively. Also, the above-mentioned sealing plug 98 is tightly disposed in a sealing relationship with the interior of the inner water tube 94, at the opposite end thereof, in order to prevent leakage at such opposite end, with the O-ring seal 93 and the sealing plug 98 thus forcing the make-up water to flow in the above-described desired flow path through the annular space 91.

After any unfrozen water has traversed the full vertical height of the ice-forming plate subassemblies 60, it converges from both of the subassemblies 60 at the apex or lower edge of the driplet member 58, which has a generally V-shaped lateral cross-sectional configuration, with a pair of inwardly and downwardly sloping driplet side surfaces 59 converging at such apex or lower end. Such driplet side surfaces 59 are generally aligned with opposite sides of the lower frame member 50 of the ice-forming assembly. The lower frame member 50 has beveled upper edges 57, each of which slope upwardly and inwardly toward the water-receiving recesses 60, and inwardly and downwardly sloping opposite sides 61 aligned with the driplet side surfaces 59, as shown in FIG. 8. The beveled upper edges 57 and the inwardly and downwardly sloping sides 61 of the lower frame member 50 facilitate the flow of unfrozen make-up water from the water-receiving recesses 65 to the driplet side surfaces 59. The driplet side surfaces 59 serve to converge flow from opposite sides of the evaporator and ice-forming assembly 40 along a very narrow region where the unfrozen water is allowed to fall or drip from the driplet member 58 into a narrow sump channel, such as that shown in FIG. 2. By such a construction, the evaporator and ice-forming device 40 eliminates the need for two separate sumps to serve the two opposite sides of the ice-forming assembly, as well as allowing for a much narrower and compact sump and channel arrangement. This is advantageous in eliminating interference between the discharged ice products and the sump system. In this regard, the downwardly and inwardly sloping lower walls 101 of the ice shields 100 also contribute to the convergence of any unfrozen water that does not adheringly flow due to surface tension along the desired path provided by the lower frame member 50 and the driplet member 58.

The ice shields 100 are disposed on opposite sides of the ice-forming plate subassemblies 60, laterally away from the water-receiving recesses 65. The ice shields 100 are preferably composed of a plastic material and have vertical side walls and the above-mentioned downwardly and inwardly sloping lower walls 101 for containing ice produced in the water-receiving recesses 65 and directing the fall of the ice products from the water-receiving recesses 65 during an ice product harvest cycle toward a predetermined ice storage region of the ice-making machine. Preferably, the ice shields 100 have generally hook-shaped upper ends 102, shown in FIG. 8, that pivotally engage the above-mentioned pivot pins 99 on the retainer members 54. This construction allows for pivotal outward and inward movement of the ice shields toward and away from their respective water-receiving recesses 65 in order to allow ice products falling therefrom to be discharged into the ice storage region.

The ice shields 100 also have been found to contribute to a thermal insulation effect on the ice-forming plate assemblies 60 by isolating a much smaller mass of air against the plate assemblies 60 and by tending to inhibit the flow of air over the plate assemblies 60, especially due to the lower walls 101 and the hook-shaped upper ends 102 acting as air flow "dampers" or "baffles". In fact, prototype testing of the invention has shown a six percent increase in ice production with the ice shields 100 over that attainable without them. In this regard other air flow inhibiting caps or inserts can also be added, such as the optional cap 106 shown, for example, in FIG. 8. Such a cap 106 substantially fills the entire length of the opening between the ends 102 and the side members 46 and 48, with only very small clearance being provided to allow removal of the ice shields 100.

Figure 14:
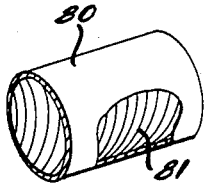
FIG. 14 is a fragmentary view of a portion of one version of the evaporator tube for the combination evaporator and ice-forming device of FIG. 1, illustrating a spirally rifled interior construction used in some applications.

Finally, referring to FIG. 14, it should be noted that the tubing used to form the generally serpentine evaporator tube 80 can optionally be provided with "rifling", consisting of grooves extending along the interior wall of the evaporator tube 80 in a spiral configuration therealong. Such rifling has been found to be advantageous in some applications, especially those involving somewhat larger tube diameters in larger capacity ice-making machines, in order to increase the tubulent mixing of the refrigerant within the evaporator tube 80. In smaller capacity applications, however, it has been found that such rifling is not necessarily needed.

The foregoing discussion discloses and describes exemplary embodiments of the present invention. One skilled in the art will readily recognize from such discussion and from the accompanying drawings and claims, that various changes, modifications, and variations can be made therein without departing from the spirit and scope of the invention as defined in the following claims.

What is claimed is:

1. In an evaporator and ice-forming device for an ice-making machine having a water inlet adapted for fluid communication with a source of water, an evaporator tube adapted for fluid communication with a source of refrigerant, at least one ice-forming plate assembly disposed in close heat transfer proximity with said evaporator tube, and water distribution means for distributing water from said water inlet to said ice-forming plate assembly, the improvement wherein said ice-forming plate assembly includes an inner plate member having one side thereof disposed in close heat transfer proximity with said evaporator tube and having a number of elongated openings extending therethrough, a number of generally horizontally-extending grid members serially spaced vertically along an outer side of said inner plate member, and a number of generally vertically-extending grid members serially spaced horizontally along said outer side of said inner plate member and interlockingly intersecting said vertically spaced horizontal grid members, said intersecting horizontal and vertical grid members extending laterally outwardly from said inner plate member and intersecting one another to define the sides of a number of rows of open, outwardly-facing water-receiving recesses therebetween with said inner plate member defining the floors of said water-receiving recesses, said vertical and horizontal grid members being disposed on an opposite side of said inner plate member from the evaporator tube to form an interlocking grid subassembly, said grid subassembly having a number of laterally inwardly-protruding tabs thereon, said tabs extending through said elongated openings in said inner plate member and being bent over on the evaporator tube side of said inner plate member in order to interlockingly secure said horizontal and vertical grid members to said inner plate member and to form said ice-forming plate assembly, said ice-forming plate assembly and said evaporator tube being coated with a heat conductive coating after said grid subassembly is secured to said inner plate member, said grid subassembly including water communication openings formed therein generally adjacent at least some of said intersections of said vertical and horizontal grid members in order to provide for a fluid communication between adjacent rows of said water-receiving recesses.

2. The invention according to claim 1, wherein said evaporator and ice-forming device includes a pair of said ice-forming plate assemblies, one of said ice-forming plate assemblies being disposed on each of opposite sides of said evaporator tube, and fastener 82, 84 means for securing said ice-forming plate assemblies to one another with said evaporator tube therebetween.

3. The invention according to claim 2, wherein said secured-together ice-forming plate assemblies with said evaporator tube therebetween are coated with a heat conductive coating.

4. In an evaporator and ice-forming device for an ice-making machine having a water inlet adapted for fluid communication with a source of water, an evaporator tube adapted for fluid communication with a source of refrigerant, at least one ice-forming plate assembly disposed in close heat transfer proximity with said evaporator tube, and water distribution means for distributing water from said water inlet to said ice-forming plate assembly, the improvement wherein said ice-forming plate assembly includes an inner plate member having one side thereof disposed in close heat transfer proximity with said evaporator tube and having a number of elongated openings extending therethrough, a number of generally horizontally-extending grid members serially spaced vertically along an outer side of said inner plate member, and a number of generally vertically-extending grid members serially spaced horizontally along said outer side of said inner plate member and interlockingly intersecting said vertically spaced horizontal grid members, said intersecting horizontal and vertical grid members extending laterally outwardly from said inner plate member and intersecting one another to define the sides of a number of rows of open, outwardly-facing water-receiving recesses therebetween with said inner plate member defining the floors of said water-receiving recesses, said vertical and horizontal grid members being disposed on an opposite side of said inner plate member from the evaporator tube to form an interlocking grid subassembly, said grid subassembly having a number of laterally inwardly-protruding tabs thereon, said tabs extending through said elongated openings in said inner plate member and being bent over on the evaporator tube side of said inner plate member in order to interlockingly secure said horizontal and vertical grid members to said inner plate member and to form said ice-forming plate assembly, said ice-forming plate assembly and said evaporator tube being coated with a heat conductive coating after said grid subassembly is secured to said inner plate member, said horizontal and vertical grid members having complementary inwardly and outwardly-extending interlocking slots spaced apart therein along opposite inner and outer edges of said grid members generally at the intersections thereof, said interlocking slots in said horizontal grid members interlockingly receiving said intersecting vertical grid members, and said interlocking slots in said vertical grid members interlockingly receiving said horizontal grid members, said grid subassembly including water communication openings formed therein generally adjacent at least some of said intersections of said vertical and horizontal grid members in order to provide for a fluid communication between adjacent rows of said water-receiving recesses.

5. The invention according to claim 4, wherein said vertical grid members have their interlocking slots spaced apart along their outer edges generally at said intersections, horizontal grid members have their interlocking slots spaced apart along their inner edges generally at said intersections, and said water communication openings being formed in said vertical grid members and spaced generally along the inner edges thereof, said interlocking slots in said horizontal grid members cooperating with said water communication openings for providing said fluid communication between said adjacent rows of said water-receiving recesses.

6. The invention according to claim 5, wherein said evaporator and ice-forming device includes a pair of said ice-forming plate assemblies, one of said ice-forming plate assemblies being disposed on each of opposite sides of said evaporator tube, and fastener means for securing said ice-forming plate assemblies to one another with said evaporator tube therebetween.

7. The invention according to claim 6, wherein said secured-together ice-forming plate assemblies with said evaporator tube therebetween are coated with a heat conductive coating.

8. In an evaporator and ice-forming device for an ice-making machine having a water inlet adapted for fluid communication with a source of water, an evaporator tube adapted for fluid communication with a source of refrigerant, at least one ice-forming plate assembly disposed in close heat transfer proximity with said evaporator tube, and water distribution means for distributing water from said water inlet to said ice-forming plate assembly, the improvement wherein said ice-forming plate assembly includes an inner plate member having one side thereof disposed in close heat transfer proximity with said evaporator tube and having a number of elongated openings extending therethrough, a number of generally horizontally-extending grid members serially spaced vertically along an outer side of said inner plate member, and a number of generally vertically-extending grid members serially spaced horizontally along said outer side of said inner plate member and interlockingly intersecting said vertically spaced horizontal grid members, said intersecting horizontal and vertical grid members extending laterally outwardly from said inner plate member and intersecting one another to define the sides of a number of rows of open, outwardly-facing water-receiving recesses therebetween with said inner plate member defining the floors of said water-receiving recesses, said vertical and horizontal grid members being disposed on an opposite side of said inner plate member from the evaporator tube to form an interlocking grid subassembly, said grid subassembly having a number of laterally inwardly-protruding tabs thereon, said tabs extending through said elongated openings in said inner plate member and being bent over on the evaporator tube side of said inner plate member in order to interlockingly secure said horizontal and vertical grid members to said inner plate member and to form said ice-forming plate assembly, said ice-forming plate assembly and said evaporator tube being coated with a heat conductive coating after said grid subassembly is secured to said inner plate member, said evaporator and ice-forming device further including a single common frame assembly for generally surrounding and housing an edge area of said water distribution means, and said ice-forming plate assemblies, and said evaporator tube, said common frame assembly being adapted for mounting said evaporator and ice-forming device in said ice-making machine.

9. The invention according to claim 8, wherein said common frame assembly is composed of a relatively heat insulating material.

10. In an evaporator and ice-forming device for an ice-making machine having a water inlet adapted for fluid communication with a source of water, an evaporator tube adapted for fluid communication with a source of refrigerant, at least one ice-forming plate assembly disposed in close heat transfer proximity with said evaporator tube, and water distribution means for distributing water from said water inlet to said ice-forming plate assembly, the improvement wherein said ice-forming plate assembly includes an inner plate member having one side thereof disposed in close heat transfer proximity with said evaporator tube and having a number of elongated openings extending therethrough, a number of generally horizontally-extending grid members serially spaced vertically along an outer side of said inner plate member, and a number of generally vertically-extending grid members serially spaced horizontally along said outer side of said inner plate member and interlockingly intersecting said vertically spaced horizontal grid members, said intersecting horizontal and vertical grid members extending laterally outwardly from said inner plate member and intersecting one another to define the sides of a number of rows of open, outwardly-facing water-receiving recesses therebetween with said inner plate member defining the floors of said water-receiving recesses, said vertical and horizontal grid members being disposed on an opposite side of said inner plate member from the evaporator tube to form an interlocking grid subassembly, said grid subassembly having a number of laterally inwardly-protruding tabs thereon, said tabs extending through said elongated openings in said inner plate member and being bent over on the evaporator tube side of said inner plate member in order to interlockingly secure said horizontal and vertical grid members to said inner plate member and to form said ice-forming plate assembly, said ice-forming plate assembly and said evaporator tube being coated with a heat conductive coating after said grid subassembly is secured to said inner plate member, said water distribution means including a horizontally-extending inner water tube and a horizontally-extending outer water tube generally surrounding said inner water tube, said inner water tube being in sealed fluid communication with said water inlet, and sealing means for sealing opposite ends of said inner and outer water tubes to one another, said inner and outer water tubes having an annular space therebetween disposed between said opposite sealed ends, said inner water tube having a number of generally vertically-extending inner tube openings spaced-apart along its length for providing fluid communication between the interior of said inner water tube and said annular space, said inner tube openings being spaced apart on a lower side of said inner water tube, said outer water tube having a number of generally vertically-extending outer tube openings spaced apart along its length for providing fluid communication between said annular space and the exterior of said outer water tube, said outer tube openings being spaced apart on an upper side of said outer water tube, said water distribution means being adapted for providing fluid communication for water from said water inlet, generally horizontally through said inner water tube, generally downwardly through said inner tube openings, and generally upwardly through said annular space on both opposite sides of said inner water tube to be discharged generally upwardly through said outer tube openings to both of opposite sides of the exterior of said outer water tube, said water distribution means being disposed generally along and adjacent an upper generally horizontal edge of said ice-forming plate assemblies in order to allow water from said water distribution means to run therefrom and to flow along the outer sides of both ice-forming plate assemblies.

* * * * *

UNITED STATES PATENT AND TRADEMARK OFFICE

CERTIFICATE OF CORRECTION

PATENT NO. : 4,903,504

DATED : February 27, 1990

INVENTOR(S) : Kenneth L. Nelson

It is certified that error appears in the above-identified patent and that said Letters Patent is hereby corrected as shown below:

Column 3, Line 27, "receycling" should be --recycling--.

Column 5, Line 24, "member" should be --members--.

Column 5, Line 26, "member" should be --members--.

Column 6, Line 47, "optinally" should be --optionally--.

Column 7, Line 11, "opening" should be --openings--.

Column 9, Line 18, "tubulent" should be --turbulent--.

Column 10, Line 12, Claim 2, delete "82, 84" after --fastener--.

Signed and Sealed this

Twentieth Day of August, 1991

*Attest:*

HARRY F. MANBECK, JR.

*Attesting Officer*

*Commissioner of Patents and Trademarks*